US009705231B2

(12) United States Patent
Cheng et al.

(10) Patent No.: US 9,705,231 B2
(45) Date of Patent: Jul. 11, 2017

(54) NETWORK CABLE SOCKET SET AND PROTECTIVE COVER THEREOF

(71) Applicant: ASUSTeK COMPUTER INC., Taipei (TW)

(72) Inventors: Kuo-Chou Cheng, Taipei (TW); Chun-Dao Yu, Taipei (TW); Chyi-Cheng Wang, Taipei (TW); Kai-Yu Chang, Taipei (TW)

(73) Assignee: ASUSTeK COMPUTER INC., Taipei (TW)

( * ) Notice: Subject to any disclaimer, the term of this patent is extended or adjusted under 35 U.S.C. 154(b) by 0 days.

(21) Appl. No.: 14/620,193

(22) Filed: Feb. 12, 2015

(65) Prior Publication Data

US 2015/0229064 A1 Aug. 13, 2015

(30) Foreign Application Priority Data

Feb. 12, 2014 (CN) ..... 2014 1 0048494

(51) Int. Cl.
*H01R 13/44* (2006.01)
*H01R 13/453* (2006.01)
*H01R 24/64* (2011.01)

(52) U.S. Cl.
CPC ..... *H01R 13/453* (2013.01); *H01R 24/64* (2013.01); *H01R 2201/04* (2013.01)

(58) Field of Classification Search
CPC ..... H01R 13/64; H01R 13/447
USPC ..... 439/142
See application file for complete search history.

(56) References Cited

U.S. PATENT DOCUMENTS

| | | | | |
|---|---|---|---|---|
| 7,988,478 | B2 * | 8/2011 | Wang | H01R 13/506 439/304 |
| 2015/0229064 | A1 * | 8/2015 | Cheng | H01R 13/453 439/142 |
| 2015/0295338 | A1 * | 10/2015 | Drake | H01R 13/443 439/148 |
| 2015/0303607 | A1 * | 10/2015 | Cullins | H01R 13/465 439/148 |

FOREIGN PATENT DOCUMENTS

| | | |
|---|---|---|
| CN | 2476886 | 2/2002 |
| CN | 202282503 U | 6/2012 |
| CN | 202616530 | 12/2012 |
| CN | 202616530 U * | 12/2012 |

OTHER PUBLICATIONS

CN 202616530 translated document attached.*

* cited by examiner

*Primary Examiner* — Dac D Ta
*Assistant Examiner* — Nader Alhawamdeh
(74) *Attorney, Agent, or Firm* — Jianq Chyun IP Office

(57) ABSTRACT

A protective cover for a network cable socket is disclosed. The protective cover is moveably connected to the network cable socket. The protective cover of the network cable socket comprises a housing and two elastic sheets. The housing is moveably connected to the network cable socket. Each of the elastic sheets includes a fixing portion, an extension arm, a stopper and a guiding ramp. The two extension arms are connected to the two fixing portions, respectively. The two fixing portions are fixed to two sides of the housing, respectively. The two stoppers and the two guiding ramps are formed at the two extension arms, respectively. A distance between the two guiding ramps is larger than the distance between the two stoppers.

5 Claims, 3 Drawing Sheets

NETWORK CABLE SOCKET SET AND PROTECTIVE COVER THEREOF

CROSS-REFERENCE TO RELATED APPLICATION

This application claims the priority benefit of China application serial No. 201410048494.0, filed on Feb. 12, 2014. The entirety of the above-mentioned patent application is hereby incorporated by reference herein and made a part of specification.

BACKGROUND OF THE INVENTION

Field of the Invention

The invention relates to a connector, more particularly, to a network cable connector.

Description of the Related Art

Generally speaking, when wired network is used, a network cable connector needs to be plugged into a network cable socket of an electrical device to transmit a network signal. However, the network cable socket is generally integrated to the electrical device, which effect the thickness of electronic products (such as a notebook computer).

Currently, the network cable socket in the market is mainly matched to an RJ45 connector. Since the size of the RJ45 connector is relatively large, users are easily to insert a non-network cable connector with a related smaller size (such as an RJ11 connector) into the network cable socket by mistake. The pins in the network cable socket may be out of shape due to the squeeze of a wrong cable connector.

BRIEF SUMMARY OF THE INVENTION

A protective cover for a network cable socket is disclosed. The network cable socket with a foolproof configuration effectively prevents destroying the pins of the connector when a non-network cable connector plugged into the network cable socket by mistake.

The protective cover is moveably connected to the network cable socket. The protective cover of the network cable socket comprises a housing and two elastic sheets. The housing is moveably connected to the network cable socket. Each of the elastic sheets includes a fixing portion, an extension arm, a stopper and a guiding ramp. The two extension arms are connected to the two fixing portions, respectively. The two fixing portions are fixed to the two sides of the housing, respectively. The two stoppers and the two guiding ramps are formed at the two extension arms, respectively. A distance between the two guiding ramps is larger than the distance between the two stoppers.

In an embodiment, the distance between the two guiding ramps is smaller than a width of a network cable connector.

A network cable socket set is applied to a portable electronic device. The network cable socket set comprises a network cable socket including multiple pins and a protective cover including a housing and two elastic sheets. The protective cover is moveably connected to the network cable socket. Each of the elastic sheets comprises a fixing portion, an extension arm, a stopper and a guiding ramp. The two fixing portions are fixed to the two sides of the housing, respectively. The two extension arms are connected to the two fixing portions, respectively and the two stoppers and the two guiding ramps are formed at the two extension arms, respectively. The network cable socket and the protective cover form an opening, and a distance between the guiding ramp and the opening is smaller than the distance between the stopper and the opening.

In sum, the two elastic sheets include two stoppers and two guiding ramps at the two second ends respectively. The distance between the two stoppers is smaller than the width of a non-network cable connector, and the distance between the two guiding ramps is larger than the width of the non-network cable connector. When the non-network cable connector with a small size is plugged into the opening, it stops by the two stoppers. Therefore the non-network cable connector cannot be plugged directly into the network cable socket with the fool-proofing configuration. In addition, since the distance between the two guiding ramps is smaller than the width of a network cable connector, and the guiding ramp is closer to the opening than the stopper, when the network cable connector enters the accommodation space, the network cable connector contacts and pushes the two guiding ramps. The two guiding ramps move along the direction away from the pins, and then the two stoppers also move downwards. Thus, the network cable connector can be plugged into the network cable socket.

DETAILED DESCRIPTION OF THE EMBODIMENTS

Figure 1:
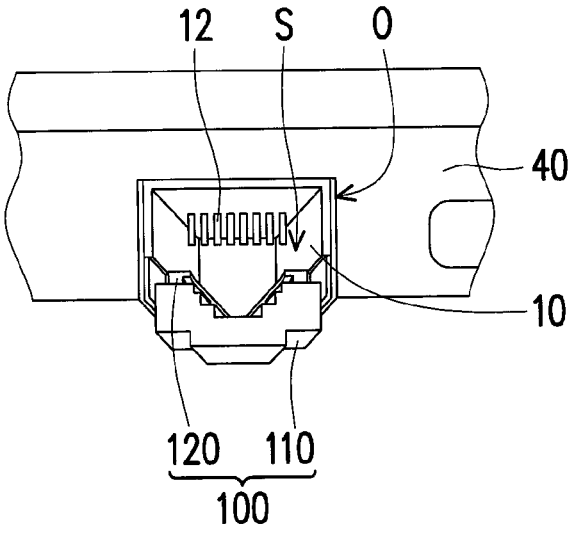
FIG. 1 is a schematic diagram showing a network cable socket set in an embodiment.

FIG. 1 is a schematic diagram showing a network cable socket set in an embodiment. Please refer to FIG. 1, the network cable socket set includes a network cable socket 10 and a protective cover 100 moveably connected to the network cable socket 10. In an embodiment, the protective cover 100 is pivotally connected to the network cable socket 10. The network cable socket 10 and the protective cover 100 are applied to a portable electronic device 40. In the embodiment, the portable electronic device 40 is a notebook computer, which is not limited herein.

In the embodiment, the network cable socket 10 is a half-section type socket. When no network cable connector 30 is plugged into the network cable socket 10, the protective cover 100 moveably connected to the network cable socket 10 in a close state to reduce the whole thickness of the electronic device 40. When the network cable connector 30 is plugged into the network cable socket 10, the protective cover 100 of the network cable socket can be moved down-ward as showed in FIG. 1, which allows the network cable connector 30 to be inserted into an accommodation space S formed between the network cable socket 10 and the protective cover 100. In the embodiment, the network cable socket 10 is matched to the RJ45 connector, and the number of the pins 12 in the network cable socket 10 is eight. However, the number of the pins 12 in the network cable socket 10 may change according to the type of the network cable connector.

Figure 2:
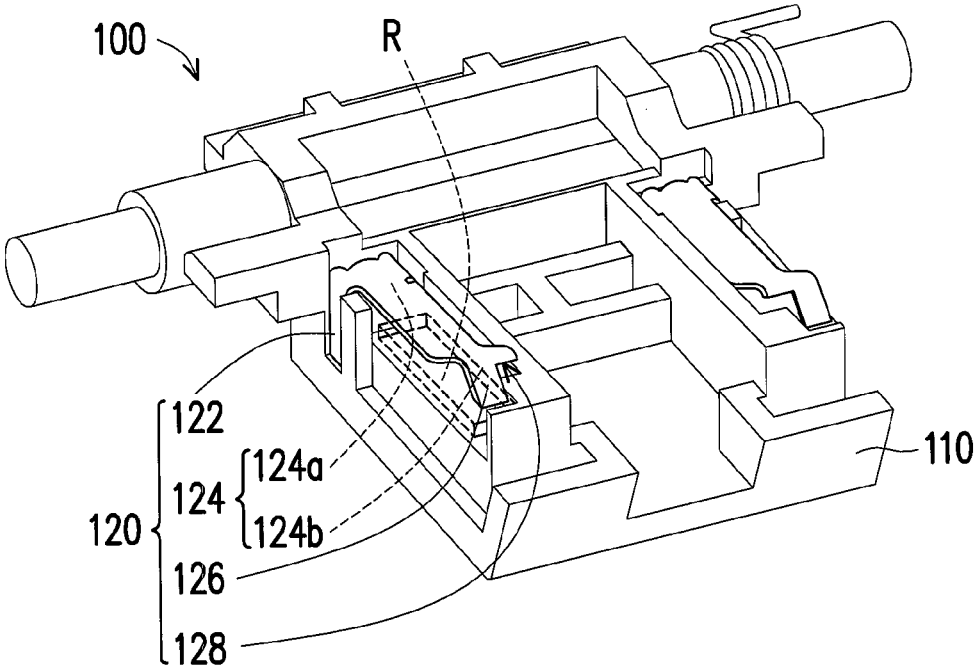
FIG. 2 is a schematic diagram showing a protective cover of the network cable socket in FIG. 1.
Figure 3:
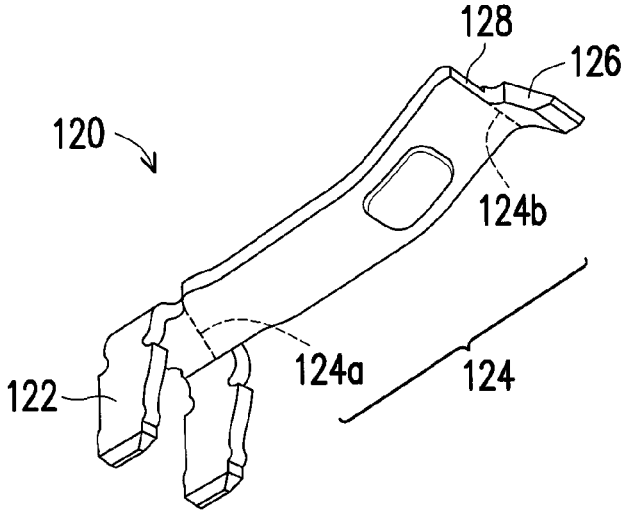
FIG. 3 is a schematic diagram showing an elastic sheet of the network cable socket in FIG. 1.

In order to describe the detailed structure of the protective cover of the network cable socket more clearly, the protective cover 100 of the network cable socket and the elastic sheet 120 are shown in different views with omitting the network cable socket. FIG. 2 is a schematic diagram showing a protective cover of the network cable socket in FIG. 1, and FIG. 3 is a schematic diagram showing an elastic sheet of the network cable socket in FIG. 1.

In the embodiment, the protective cover 100 of the network cable socket includes a housing 110 and the two elastic sheets 120. The housing 110 is moveably connected to the network cable socket 10. Please refer to FIG. 2 and FIG. 3, each elastic sheet 120 includes a fixing portion 122, an extension arm 124, a guiding ramp 126 and a stopper 128. The two fixing portions 122 are fixed to the housing 110 respectively, and they are close to the two sides of the accommodation space S. The fixing portion 122 can be fixed to the housing 110 by locking, attaching or injection molding. In the elastic sheet 120, the extending direction of the fixing portion 122 is perpendicular to the extending direction of the extension arm 124. As shown in FIG. 1, the fixing portion 122 extends along the direction away from the pins 12. The angle between the fixing portion 122 and the extension arm 124 may be 90 degrees or a non-zero angle that can provide a good fixing effect. As long as the fixed portion 122 can be firmly fixed to the housing 110, the shape of the fixed portion 122 is not limited herein.

Each extension arm 124 includes a first end 124*a* and a second end 124*b*. In the embodiment, the two first ends 124*a* of the two extension arms 124 are connected to the two fixing portions 122, respectively, and the two second ends 124*b* of the two extension arms 124 extend towards the opening O. The two stoppers 128 are formed at the two second ends 124*b* of the two extension arms 124. In the embodiment, the stopper 128 is a plate at the second end 124*b* of the extension arm 124, and it is perpendicular to the plugging direction of the network cable connector 30. However, in other embodiments, the stopper 128 can be other components formed at the second end 124*b*.

In addition, the two guiding ramps 126 are formed at the two second ends 124*b*, respectively. The distance between the two guiding ramps 126 is larger than that between the two stoppers 128. The guiding ramp 126 in FIG. 1 inclines towards the opening O. The guiding ramp 126 is gradually away from the pins 12 along the extending direction towards the opening O, that is, the guiding ramp 126 gradually extends downwardly in FIG. 1 along with the extending of the guiding ramp 126 towards the opening O.

It is illustrated hereinafter that how to achieve the fool-proofing effect via the protective cover 100 of the network cable socket when the non-network cable connector 20 is plugged and how to make the network cable connector 30 plugged into the network cable socket smoothly.

Figure 4:
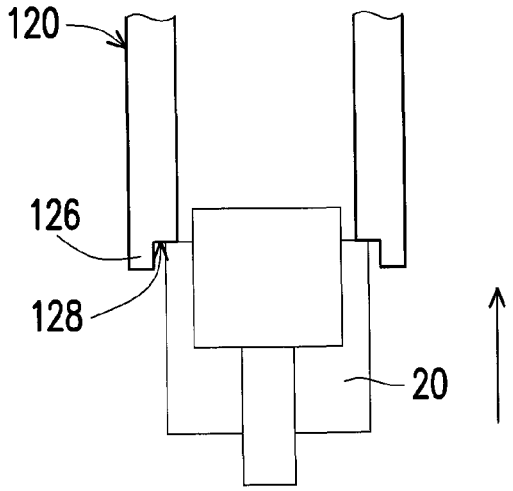
FIG. 4 is a top view showing a relative position of a non-network cable connector and an elastic sheet when the non-network cable connector is plugged into a network cable socket.

FIG. 4 is a top view showing a relative position of a non-network cable connector and an elastic sheet when the non-network cable connector is plugged into a network cable socket. Please refer to FIG. 4, in the embodiment, since the distance between the two stoppers 128 is smaller than the width of the non-network cable connector 20, and the distance between the two guiding ramps 126 is larger than the width of the non-network cable connector 20, when the non-network cable connector 20 (such as a RJ11 connector or a RJ12 connector) whose size is smaller than that of the network cable connector 30 is plugged into the opening O, the non-network cable connector 20 is blocked by the two stoppers 128 and cannot be inserted into the network cable socket. Thus, the non-network cable connector 20 cannot contact the pins 12 in the network cable socket 10 and the pins would not be out of shape.

Figure 5A:
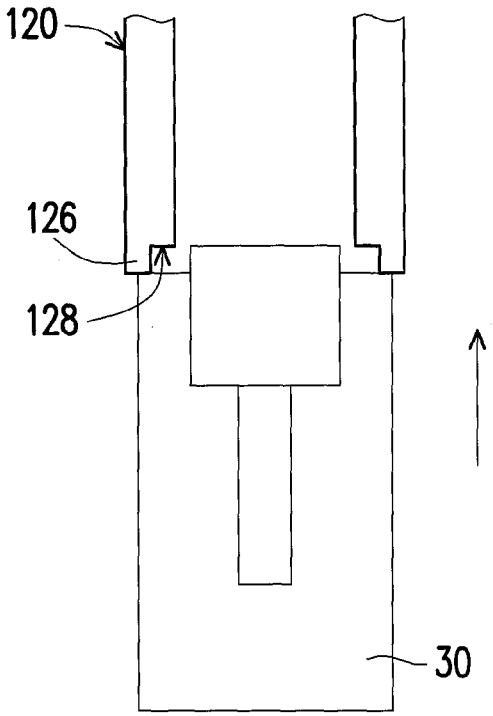
FIG. 5A is a top view showing a relative position of a network cable connector and an elastic sheet when the network cable connector is plugged into a network cable socket.
Figure 5B:
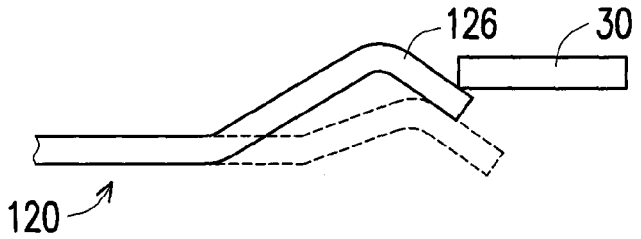
FIG. 5B is a side view showing the network cable connector and the elastic sheet in FIG. 5A.

FIG. 5A is a top view showing a relative position of a network cable connector and an elastic sheet when the network cable connector is plugged into a network cable socket. FIG. 5B is a side view showing the network cable connector and the elastic sheet in FIG. 5A. Please refer to FIG. 5A and FIG. 5B, the distance between the two guiding ramps 126 is smaller than the width of the network cable connector 30 (such as a RJ45 connector). The guiding ramp 126 is closer to the bottom of the FIG. 5A than the stopper 128, that is, compared with the stopper 128, the guiding ramp 126 is much closer to the opening O, Thus, when the network cable connector 30 is inserted from the bottom (which is the opening in FIG. 1) of the FIG. 5A to the top, the network cable connector 30 contacts the two guiding ramps 126 directly and pushes the two guiding ramps 126 when the network cable connector 30 is gradually inserted. The housing 110 includes a receiving space R under the guiding ramp 126 (as shown in FIG. 2), the two guiding ramps 126 move downwardly (which means along the direction away from the pins 12) when they are pressed by the network cable connector 30. As a result, the stopper 128 at the second end 126*b* of the extension arm 124 moves downwardly so that it would not block the network cable connector 30. Thus, the network cable connector 30 can enter the accommodation space S and contact the pins 12 of the network cable socket 10.

In the embodiment, the protective cover 100 of the network cable socket is in a size that can allow the insertion of the RJ45 connector and block the RJ11 connector. Thus, the distance between the two stoppers 128 is smaller than 9.65 mm, and the distance between the two guiding ramps 126 is between 9.65 mm to 11.68 mm. In other embodiments, the distance between the two stoppers 128 and the distance between the two guiding ramps 126 can be adjusted based on the size of the connector, so as to achieve a fool-proofing effect.

In sum, the two elastic sheets include two stoppers and two guiding ramps at the two second ends, respectively. The distance between the two stoppers is smaller than the width of a non-network cable connector, and the distance between the two guiding ramps is larger than the width of the non-network cable connector. When the non-network cable connector with a small size is plugged into the opening, it just contacts the two stoppers and is blocked by the two stoppers. The non-network cable connector cannot be plugged into the network cable socket, and thus a fool-proofing effect is achieved. In addition, since the distance between the two guiding ramps is smaller than the width of a network cable connector, and the guiding ramp is closer to the opening than the stopper, when the network cable connector enters the accommodation space, the network cable connector contacts and pushes the two guiding ramps. The two guiding ramps move along the direction away from the pins, and then the two stoppers also move downwards. Thus, the network cable connector can be plugged into the network cable socket.

Although the present invention has been described in considerable detail with reference to certain preferred embodiments thereof, the disclosure is not for limiting the scope. Persons having ordinary skill in the art may make various modifications and changes without departing from the scope. Therefore, the scope of the appended claims should not be limited to the description of the preferred embodiments described above.

What is claimed is:

1. A protective cover for a network cable socket, wherein the protective cover is moveably connected to the network cable socket, the network cable socket includes multiple pins and is adapted to be inserted by a connector, the protective cover of the network cable socket comprising:

a housing moveably connected to the network cable socket; and two elastic sheets, wherein each of the elastic sheets includes a fixing portion, an extension arm, a stopper and a guiding ramp, the two fixing portions are fixed to two sides of the housing, respectively, each of the extension arms includes a first end and a second end, the two first ends of the two extension arms are connected to the two fixing portions, respectively, and the two stoppers and the two guiding ramps are formed at two second ends of the two extension arms, respectively;

wherein a distance between the two guiding ramps is larger than the distance between the two stoppers, the network cable socket and the protective cover form an opening, the guiding ramp faces the opening obliquely, and the guiding ramp is away from the pins along an extending direction towards the opening, wherein a width of the connector is larger than the distance between the two guiding ramps, the protective cover is adapted to move down-ward so as to allow the connector to be inserted into the opening, when the connector is plugged into the opening, the connector pushes the two guiding ramps to move down-ward, the two stoppers at the two second ends of the extension arms are moved accordingly, the connector is not blocked by the two stoppers.

2. The protective cover for the network cable socket according to claim 1, wherein the housing includes a receiving space under the guiding ramps.

3. The protective cover for the network cable socket according to claim 1, wherein the fixing portions are perpendicular to an extending direction of the extension arms.

4. A network cable socket set, adapted to be applied to a portable electronic device, the network cable socket set comprising:

a network cable socket including multiple pins and is adapted to be inserted by a connector; and a protective cover including a housing and two elastic sheets, wherein the protective cover is moveably connected to the network cable socket, each of the elastic sheets includes a fixing portion, an extension arm, a stopper and a guiding ramp, the two fixing portions are fixed to the two sides of the housing, respectively, each of the extension arms includes a first end and a second end, the two first ends of the two extension arms are connected to the two fixing portions, respectively, the two stoppers and the two guiding ramps are formed at two second ends of the two extension arms, respectively;

wherein the network cable socket and the protective cover form an opening, and a distance between the guiding ramp and the opening is smaller than the distance between the stopper and the opening, wherein the guiding ramp faces the opening obliquely, and the guiding ramp is away from the pins along an extending direction towards the opening, wherein a width of the connector is larger than the distance between the two guiding ramps, the protective cover is adapted to move down-ward so as to allow the connector to be inserted into the opening, when the connector is plugged into the opening, the connector pushes the two guiding ramps to move down-ward, the two stoppers at the two second ends of the extension arms are moved accordingly, the connector is not blocked by the two stoppers.

5. The network cable socket set according to claim 4, wherein the housing includes a receiving space under the guiding ramps.

* * * * *